US005882280A

United States Patent [19]

Dahlin, Jr.

[11] Patent Number: 5,882,280

[45] Date of Patent: Mar. 16, 1999

[54] CONTRACTURE MEANS AND METHODS

[75] Inventor: Warren F. Dahlin, Jr., Bridgewater, Mass.

[73] Assignee: Alimed, Inc., Dedham, Mass.

[21] Appl. No.: 951,326

[22] Filed: Oct. 16, 1997

Related U.S. Application Data

[62] Division of Ser. No. 773,556, Dec. 27, 1996.

[60] Provisional application No. 60/009,564 Jan. 3, 1996.

[51] Int. Cl.[6] ..... A63B 23/16

[52] U.S. Cl. ..... 482/44; 482/49; 601/135

[58] Field of Search ..... 482/49, 109, 44, 482/105, 121; 601/135; D24/214; 446/267, 369

[56] References Cited

U.S. PATENT DOCUMENTS

| | | | |
|---|---|---|---|
| 647,220 | 4/1900 | Courtney | 482/109 |
| 1,549,710 | 8/1925 | Campbell | 482/49 |
| 1,660,095 | 2/1928 | Schiele | 601/139 |
| 3,542,363 | 11/1970 | Bishop et al. | 482/49 |
| 4,378,113 | 3/1983 | Piccini | 482/109 |
| 4,520,799 | 6/1985 | Kruger | 601/137 |
| 4,530,496 | 7/1985 | Smith et al. | 482/49 |
| 5,020,515 | 6/1991 | Mann et al. | 602/21 |
| 5,113,849 | 5/1992 | Kuiken et al. | 602/21 |
| 5,718,655 | 2/1998 | Phillips | 482/49 |

OTHER PUBLICATIONS

Hand Pain and Impairment by Rene Cailliet, M.D., F.A. Davis Company, 1988, pp. 180–185.

Rehabilitation of the Hand; Surgery and Therapy by James M. Hunter, M.D., Evelyn J. Machin, P.T.; Anne D. Callahan, M.S., by Mosby–Year Book, Inc., 1995 (4th Edition), pp. 1372–1373.

Hand Therapy Catalog by North Coast Medical, 1995, pp. 46, 21, 24 and 20.

Orthopedic Rehabilitation Products by Alimed, 1992.

State of the Art Reviews; Physical Medicine and Rehabilitation, vol. 7, No. 1, Hanley & Belfus, Inc., 1993 pp. 140–143.

Rudds complete Specification GB0022954 Oct. 1903–a page spec. (Drwg. Only).

*Primary Examiner*—Jerome Donnelly

*Attorney, Agent, or Firm*—Wolf, Greenfield & Sacks, P.C.

[57] ABSTRACT

An elongated yieldable conical element has a nonrigid body which is compressible to a conical shape increasing in diameter from a narrow diameter end. The conical element is used in a method of treating a contracture of successive fingers of the hand by threading a narrow and of the element through successive curled fingers of the hand and engaging the conical end at about the narrow diameter end to apply outwardly directed force to the fingers of the hand to open the curl to some extent with minimized discomfort to a user.

6 Claims, 2 Drawing Sheets

CONTRACTURE MEANS AND METHODS

This application is a division of nonprovision application Ser. No. 08/773,556, filed Dec. 27, 1996, entitled CONTRACTURE MEANS AND METHODS and now allowed, which is a nonprovisional continual application of provisional application Ser. No. 60/009,564 filed Jan. 3, 1996.

BACKGROUND OF THE INVENTION

After a stroke or other neurological disorder, tightness of the hand muscles of an individual can often lead to debilitating contracture of the fingers of the hand, resulting in a fist-like deformity. Often this condition can be prevented by the use of splinting and other medical means, but this can be painful and often the patient is unwilling to go through painful procedures such as stretching and range of motion exercises. The contracture or tightness, if not treated often becomes worse and can lead to the finger nails puncturing the flesh infection of palm and spaces between the finger and thumb can result from difficulty in cleaning the tightly fisted hand.

Health practitioners, such as occupational therapists, physical therapists and nursing staff, often try to wedge the hand open as with a folded washcloth or roll of gauze bandage. Other common means of keeping the hand open to prevent further contracture once started, include the use of conical tubes. Cone shaped tubes are generally made of rigid plastic and may be covered with some sort of thin material to make them more comfortable. Often lengths from 4 to 5 inches and widths tapering from ¾ inch to 1½ inches in diameter are used. Other methods dealing with contractures are the use of palm splints. Such splints fit in the palm and are intended to rest between the fingers and the palm surface and to act as a barrier to prevent the fingers from digging into the palm of the skin. In extreme cases, surgery where tendons are severed, is a last, painful and often ineffective resort. It is a particular problem with any of the known devices that their use requires the fingers to be pried open before inserting the device into the tightly-clenched fist. This opening of the fingers can be extremely painful and in some cases can cause dislocation of a joint when done by the therapist, other medical practitioner or family care giver. The force exerted during prying of the fingers can be considerable in order to insert a splint and or the aforementioned cone devices which require forcing of the cone through the widest opening of the clenched fist towards the narrowest opening of the fingers. To insert even a washcloth or gauze roll can be painful and traumatic for the patient because of the necessary finger prying apart.

SUMMARY OF THE INVENTION

It is an object of this invention to provide a method of treating contractures of successive fingers of the hand by gently spreading the fingers of the hand apart through the use of a a yieldable, generally-conical element wherein pre-spreading of the fingers prior to use of the element is minimized or eliminated.

Another object of this invention is to provide an elongated yieldable element having an essentially small diameter and a large diameter end with a nonrigid body which is resiliently compressible to a second smaller diameter shape, with a narrow diameter end being small enough to minimize or eliminate preopening of a curl of the hand in a contracture of the fingers of the hand.

According to the invention, a method of treating a contracture of successive fingers of the hand of an individual wherein the fingers are curled to form an elongated restricted area having an elongated axis at the inside of the curl of the fingers, is provided. An elongated yieldable generally conical element is threaded through successive curled fingers of the hand with the conical element having a narrow diameter end and an enlarged diameter end. The threading is carried out by inserting the narrow diameter end as far under the curled area of each successive finger as possible without causing discomfort of the individual and then engaging the conical element at, or substantially at, the narrow diameter end to force the element further into the restricted area and gradually increase the size of the restricted area about the elongated axis and thus act to open the curl to at least some extent. The expanding action is enhanced by sliding of the conical element which provides a cushioning and gradually opening effect to the fingers acting as an inclined plane.

In the preferred embodiment, the conical element is pulled through the restricted area by attachment of a pulling device at the narrow diameter end. The pulling device can be an elongated yieldable rod which can be hooked to a thread or other attachment device at the narrow diameter end of the element. In some cases, the conical element can be an inflatable device which is preferably inflated prior to use.

Preferably an elongated yieldable conical element has an axial length at least about 4½ inches with a large diameter end of at least about ¾ inch and a small diameter preferably tapering to the tip of the cone. The narrow diameter end is dimensioned and arranged to be threaded through the curl without preopening of a curl so that the curl can be expanded by exerting gentle steady increading force using the conical member to gradually expand the curl by a sliding action thereof. In some cases the conical element can be inflatable and/or can carry means for attaching a pulling device to the small diameter end. When the pulling device is used, it is preferably an elongated rod attached to the means on the narrow diameter end of the element. In some cases, an elongated stiffening rod can be used internally in the element to enable the element to be pushed by a force applied through the large diameter end although in the preferred embodiments, force is applied as a pulling force acting through the small diameter end of the conical element.

It is a feature of this invention that since the small diameter end of the conical end tapers to substantially zero diameter, or zero diameter, it can be pulled into the hand at the small finger end and is relatively easy to slide through the fingers without prepulling the fingers before entry of the element, avoiding substantial prying of the fingers and allowing the element itself to open the fingers gradually. The process of introducing the device uses an inclined plane principal to exert force, while the hand need not be pre-opened to a diameter greater than the size of the device. In many known devices, such preopening was necessary and could cause substantial pain. Insertion of the elements of this invention can be carried out gently and slowly over a period of days or even weeks to minimize or eliminate pain and anticipated fear of pain in patients. Thus, one can build trust and increase compliance in users.

DESCRIPTION OF THE DRAWINGS

The above objects, features and advantages of the present invention will be better understood from the following specification when read in connection with the accompanying drawings in which.

DESCRIPTION OF PREFERRED EMBODIMENTS

Figure 1:
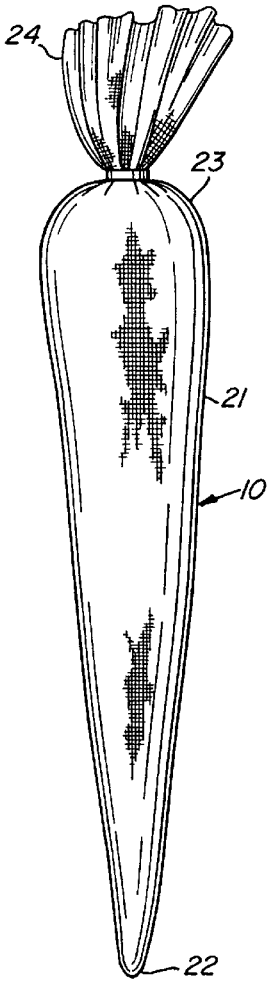
FIG. 1 is a side view through a conical element in accordance with a preferred embodiment of this invention, with the other three sides not shown being identical to the side shown.
Figure 2:
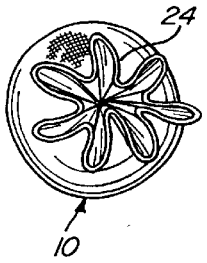
FIG. 2 is a top plan view thereof.
Figure 7:
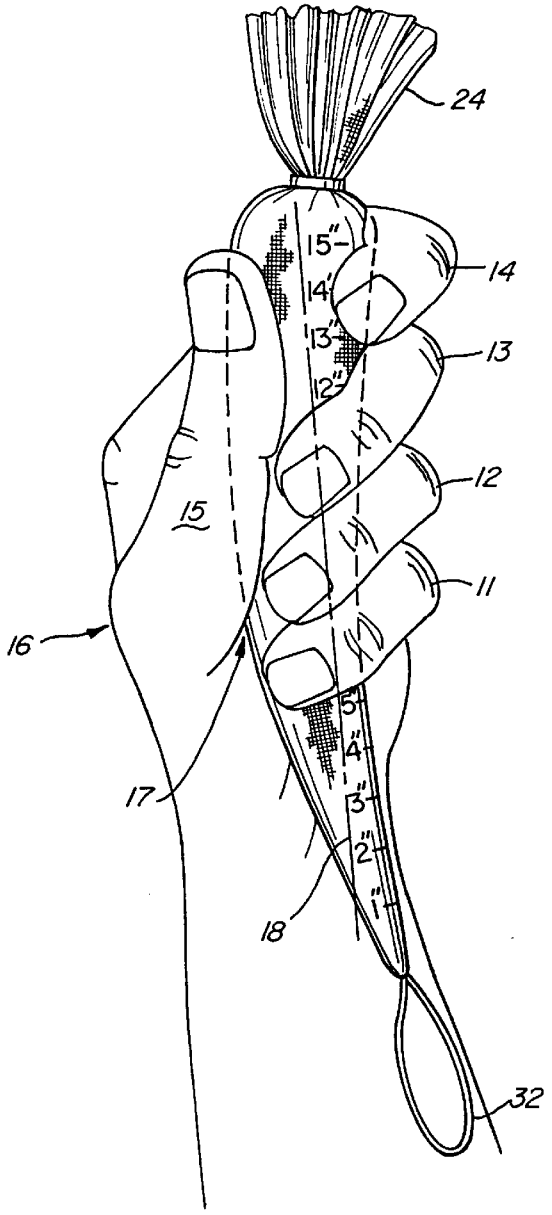
FIG. 7 is a front perspective view of a hand with which the conical element of FIG. 4 is used.

According to the invention, as best seen in FIGS. 1, 2 and 7, a generally conical element 10 can be used for treating a contracture of successive fingers 11–15 of a hand 16 of an individual wherein the fingers are curled to form an elongated restricted area 17 having an elongated axis 18 inside the curl of the fingers.

The element 10 of the preferred embodiment has the shape and decoration of a carrot. Thus, it has an outer conical, tapering shell 21 to a narrow diameter end 22 with an enlarged diameter end 23. The narrow diameter end at 22, which in the preferred embodiment is of zero diameter. It is preferred that end 22 be kept as near zero as possible as will be better understood from the subsequent discussion of the method of this invention. In some cases, the narrow diameter end can have a diameter of ¼ inch, but is preferably small enough to enter the curled restricted area without prior uncurling of the fingers. Within the conical shell or cover 21 is a stuffing which can be a resilient compressible material (shown at 30 in FIG. 3), foam particles, elastomeric materials or the like. In the preferred embodiment, the material 30 is wool fleece so that the carrot-like, conical element can be compressed in use as it is drawn through the fingers of the hand to expand the fingers. The shell 21 is preferably an orange colored cloth of cotton wool or synthetic fibers. The conical element allows a sliding action of the hand at the shell 21, and also allows some compression so as to provide a gradual opening of the fingers using an inclined plane principle.

The material 30 can be any compressible material such as elastomeric polymers, formed from foam or solid polymers in one piece or particles, such as polyvinyl chloride, synthetic or natural rubber and the like, fiber batting ravings such as cotton, wool or synthetic yarn which when compressed still allows insertion into the curl of the hand. The shell 21 can also be made of plastics such as polyethylene terephalate, nylon, polypropylene and the like to reduce friction. The shell 21 preferably uniformly tapers from end 23 to end 22.

In the preferred embodiment of FIG. 10, the carrot-like element has a length of from 4½ to 8½ inches, a narrow diameter of from zero to ⅜ inch and an enlarged end diameter of from ¾ inch to 2½ inches. The element is non-rigid when slight forces of the hand are applied to it. Thus, it can be bent, easily manipulated and is compressible and resiliently returns to its original shape. In the preferred embodiment, the compressibility of the carrot-like element is such that when the forces of the contracture are applied to it, the enlarged diameter end can, for example, be reduced by the pressure of the fingers to a diameter approximately one half its starting diameter.

The shell 21 is preferably of a cloth such as KONA cotton 100% cotton 45/45 threads/inch manufactured by Robert Telfman Co., Inc. Fabrics of the shell 21 can be natural, nonallergic, absorbent, fade resistant, shrinkage resistant, and the like. Preferably, they are washable as is the entire conical element. Other cloths such as cone broadcloth 45/45 inch 60% polyester 35% combed cotton as manufactured by Springfort of South Carolina can be used. Wool fleece for material 30 can be attained in rolls from P.O. Box 36, Harmony, Me. Other fillers such as foam, rubber, cloth and the like can be used. As best shown in FIG. 2, the preferred embodiment has a round upper surface with a plume 24 of cloth to closely simulate an artificial carrot.

Figure 3:
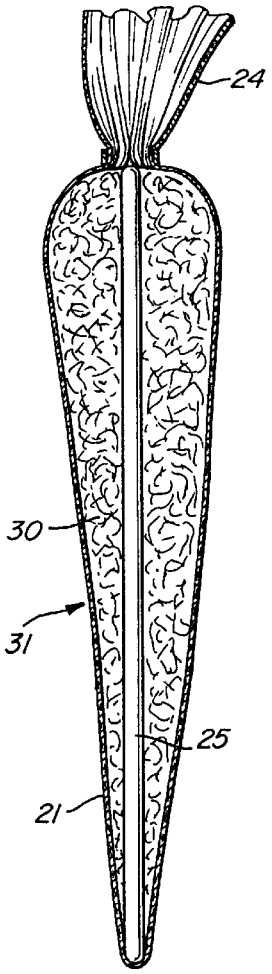
FIG. 3 is a cross sectional view through an alternate embodiment of the embodiment of FIG. 1.

In an alternate embodiment of the invention shown at 31 in cross section at FIG. 3, wool fleece 30 is provided as is the filler in the embodiment of FIG. 1. However, in this embodiment, a rigid plastic rod 25 is positioned within the carrot to enable the carrot to be pushed through the hand from the enlarged diameter end of the element 31. The rod 25 can be round, square or irregularly shaped in axial cross sections. Non-round cross-sections are preferred to prevent twisting of the filler 30 in use. This device is not as preferable as other devices of the invention since it is preferred to pull a device from its narrow diameter end wherein the pressure is exerted at the narrow diameter end. Since the narrow diameter end substantially is at zero diameter, it can be threaded through the fingers without preprying apart of the fingers to any substantial degree (this is in part due to the compressibility of the carrot as well as the substantially zero diameter end). Thus, devices such as the device of FIG. 1 are preferred since they can be pulled from the tip or narrow diameter end 22 allowing a gentler action in spreading the contracture and opening the fingers as the carrot passes through.

Figure 4:
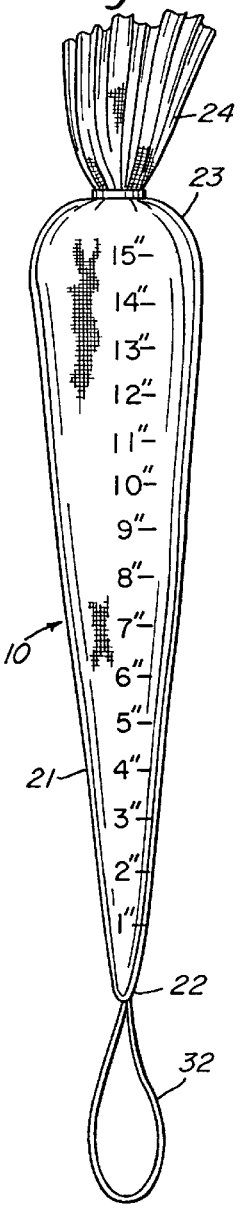
FIG. 4 is a side view of another alternate embodiment of a conical element in accordance with this invention.

In another alternate embodiment of this invention illustrated in FIG. 4, a carrot-like conical element 10, as for example, shown the embodiment of FIG. 1 is shown where all elements which are identical to the embodiment of FIG. 1 are identically numbered. In this embodiment, the only difference is that in addition to the orange colored shell 21 and plume 24, a series of graduation lines are shown from 1 to 15. These graduations can be used to indicate the progress of the carrot through the hand over time. For example, measuring the graduation line at the top of the hand, as shown in FIG. 7 during processing, on each subsequent hour, day, or minute of relief of the contracture (by advancing the carrot pulling at its narrow diameter end), one can record the date, time and degree of passage of the carrot through the contracture. This is useful to determine and monitor the regime for treating patients to relieve the contracture.

Figure 5:
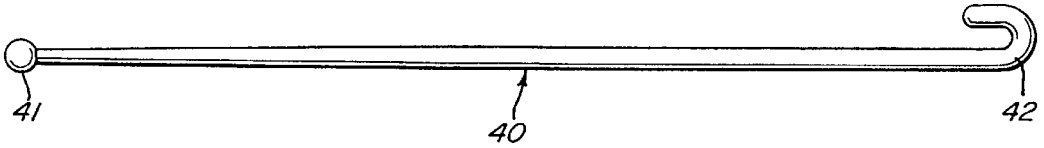
FIG. 5 is a pulling implement for use therewith.

The device of FIG. 4 further has a thread loop (32) passing through a suitably formed hole (not shown) and firmly attached to shell 21 at the narrow diameter end of the carrot-like element. The thread 32 enables one to attach a rod and hook to pull the device through the hand. A suitable pulling rod 40 is shown in FIG. 5 and preferably comprises a semi-rigid rod as, for example, of a nylon (nylon 6,6 or nylon 6 material) which is yieldable yet firm. The rod can have a length of from 4 to 10 inches or more. In a preferred embodiment of the rod 40, it has a slightly enlarged rounded end 41 and a hooked end 42. The rod can be hooked onto the threaded loop 32 and then the rod passed through the contracted fingers to enable one to pull the narrow diameter end of the carrot-like element through the contracture from its wider end to its narrow end. Since the rod is semi-rigid, it will bend to pass easily through the contracture. It can be made of narrow diameter such as from ¼ inch and yet is strong enough to enable sufficient force to be exerted on the carrot to open the fingers as the carrot is passed through the contracture.

In a preferred embodiment of the rod, it can have a length of approximately 5½ inches with the slight hook 42 at the far end, having a diameter of approximately ¼ inch for about 4 inches of the axial length of the rod then tapered for an additional 4 inches to approximately ⅛ inch with a round ball tip 41 with the ball having a diameter approximately 3/16 inch. Since the nylon rod is by nature semi-flexible, it is easily and painlessly inserted into the hand, generally from the small finger end, but could be done from either end. Because it is a flexible rod, it can bend around any asymmetric obstructions (which may include another finger that is exorbitantly contracted). Thus, it becomes a flexible rod that can be threaded through the entire closed fist hand or a portion of the fist, exiting between the fingers.

Figure 8:
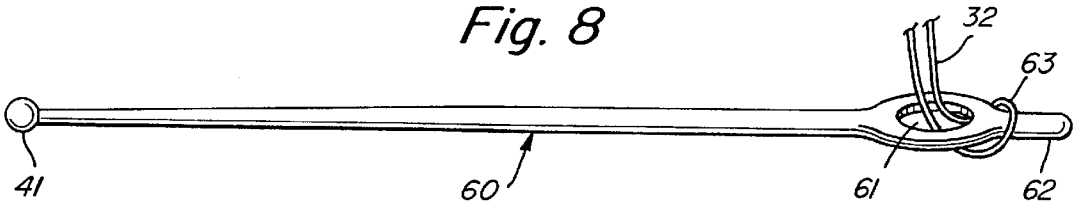
FIG. 8 is a side perspective view of an alternate embodiment of a pulling instrument useful in connection with this invention.

FIG. 8 illustrates a rod 60 similar to rod 40 and for the same purpose as rod 40. In rod 60, all parts are the same as rod 40, except that the hook is replaced with an eyelet or hole 61 which may be oval as shown or of other shapes. The eyelet is integral with rod 60 and a far end comprises a post end 62. The rod 62 is used by having the end 63 of loop 32 pass through the eyelet and over end 62. Thus, the rod 60 acts as a hook and can be used to pull the conical element into the space 17 and thus expand the curl of a contracture in a gentle movement. The largest outer width of rod 60 at the outlet is preferably extremely small as for example ¼ inch to facilitate passage of the eyelet into the contracture along axis 18 if desired.

Figure 6:
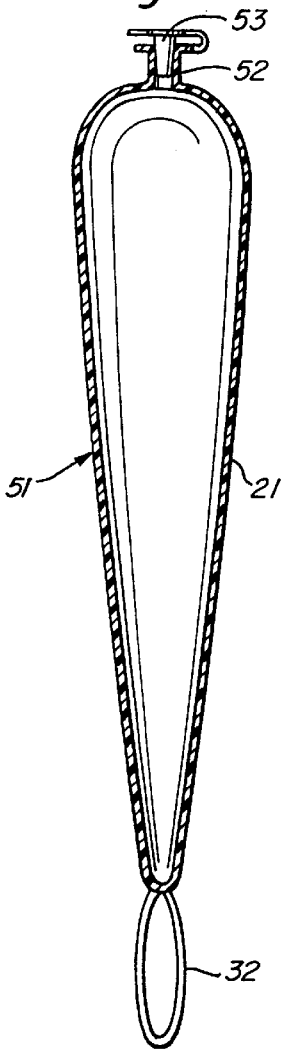
FIG. 6 is a side cross sectional view through still another embodiment of the conical element of this invention.

FIG. 6 illustrates in cross-sectional view a carrot-like conical element 51 having an outer shell 21 of gas impermeable polyvinyl chloride, and an inflation plug 52 with a stopper 53. This device is an inflatable conical element and can be used in the same manner as the elements 10 of FIGS. 1 and 4. Preferably, the embodiment is inflatable prior to use to a degree less than full inflation. In some cases, the element 51 can be deflated, positioned along axis 18 of the hand and then inflated to gently open the curl of the fingers.

Generally, the devices of this invention are engaged at the narrow diameter end to force the element further into the restricted area and gradually increase the size of the restricted area about the axis of the contracture. The conical element is preferably pulled through the restricted area causing the fingers to gradually uncurl in conical fashion with minimized prying apart action as opposed to sliding and expanding action of the conical element, which forces the expanding of the curl. The conical element is preferably intermittently pulled into the contracture, with the extent of each axial movement permitting stretching to successive equilibrium positions without undue or excessive discomfort to the patients. The conical element can be inserted into the top or bottom of the curl of the contracture, but are preferably inserted at the top as shown in FIG. 7. Sliding is a preferred mechanism so that the cloth preferably does not have characteristics which would prevent sliding against the skin without injuring the skin. In some cases, the conical element is pushed through the restricted area by an elongated rod-like device but in the preferred embodiment it is pulled through. It can be pulled through with the use of flexible rod 40 or 60 which is engaged with a narrow diameter end of the carrot-like element.

While the carrot-like conical element has been described, the shape can vary somewhat from a true cone, it is only necessary for the element to have an inclined plane or gradually increasing pressure on the curled fingers as it is pulled through the hand. Preferably, the conical element is compressible to about half of its diameter along its central axis.

While specific embodiments, have been described and shown, additional variations are possible.

What is claimed is:

1. A therapeutic hand execiser for alleviating contracture of the hand of an individual, which contracture causes fingers of the hand to form a tight curl comprising:

an elongated conical member, said conical member having a length along an axis of at least about 4½ inches with a large diameter end of at least about ¾ inch and a small diameter at a narrow diameter end, said conical member having a non-rigid body which is resiliently compressible and increasing in diameter from said narrow diameter end, said narrow diameter end being dimensioned and arranged to be threaded through said curl without preopening said curl and said curl can be expanded by forcing said conical member into said curl to gradually expand said curl by a sliding action of said conical member, a pulling rod, said pulling rod having a first pulling structure, said narrow diameter end of said conical element carrying, a second pulling structure engagable with said first pulling structure for movably engagement with said rod.

2. A device in accordance with claim 1, wherein said first pulling structure is an eyelet and said second pulling structure is a loop for releasable engagement with said rod.

3. A device in accordance with claim 1, wherein said conical element carries an elongated stiffening rod to enable said element to be pushed by a force applied through said large diameter end.

4. A device in accordance with claim 1 wherein said conical element has a carrot-like appearance with a graduation scale indicating reference points of passage through a contracture.

5. A theraputic hand exerciser for alleviating contracture of the hand of an individual, which contracture causes fingers of the hand to form a tight curl comprising:

an elongated conical member, said conical member having a length along an axis of at least about 4½ inches with a large diameter at one end said narrow end having an engagement member of at least about ¾ inch and a small diameter at another end of no more than ⅜ inch, said conical member having a non-rigid body which is resiliently compressible and increasing in diameter from said narrow diameter end, said narrow end having an engagement member, whereby said narrow diameter end can be threaded through said curl without substantially expanding said curl and said curl can be expanded by forcing said conical member into said curl to gradually expand said curl by a sliding action of said conical member and a pulling rod for releasable attachment to said engagement member at said narrow diameter end.

6. A device in accordance with claim 1, wherein said element is inflatable.

* * * * *